United States Patent [19]

Hyde et al.

[11] 4,383,889

[45] May 17, 1983

[54] PULP REFINING PROCESS AND ADDITIVE THEREFOR

[75] Inventors: James A. Hyde; Michael D. Breslin; David R. Cosper, all of Downers Grove; Roy I. Kaplan, Naperville, all of Ill.

[73] Assignee: Nalco Chemical Company, Oak Brook, Ill.

[21] Appl. No.: 300,110

[22] Filed: Sep. 8, 1981

[51] Int. Cl.[3] ..... D21C 9/00

[52] U.S. Cl. ..... 162/26; 162/76; 162/80

[58] Field of Search ..... 162/26, 76, 80, 28

[56] References Cited

U.S. PATENT DOCUMENTS 4,238,282 12/1980 Hyde ..... 162/80

FOREIGN PATENT DOCUMENTS 1266898 3/1972 United Kingdom ..... 162/28

*Primary Examiner*—William F. Smith

*Attorney, Agent, or Firm*—Joan I. Norek; John G. Premo; Robert A. Miller

[57] ABSTRACT

The present invention provdes an additive for reducing brightness loss upon pulp refining comprising in combination at least one anionic polymeric compound and at least one inorganic polymer, preferably such combinations wherein any of such anionic polymeric compounds are of low molecular weight. The preferred inorganic polyphosphates of such combination are those having average polymerization numbers of from about 10 to about 45. The weight proportion of inorganic polyphos-hate to anionic polymeric compound in such combination can be within the range of about 1:10::10:1.

The present invention also provides pulp refining processes wherein such additive is added at a sufficient amount to the pulp material being refined to reduce brightness loss, such as at dosages of from about 0.0025 to about 0.5 weight percent additive actives to dry pulp, and end product pulps produced by such processes.

6 Claims, No Drawings

PULP REFINING PROCESS AND ADDITIVE THEREFOR

TECHNICAL FIELD OF THE INVENTION

The present invention is in the technical field of pulping and paper making processes, particularly those process steps that are generally known as pulp refining processes, and additives used therein. More particularly, the present invention is in the technical field of prevention of brightness loss of paper made from pulp material that has been subjected to pulp refining and additives to pulp refining processes that prevent such brightness loss.

BACKGROUND OF THE INVENTION

Pulp is the raw material used to manufacture paper and paper products. It is produced by the mechanical and/or chemical treatment of plant substances that contain cellulose. Both types of treatments are directed at converting bulk cellulosic material, such as wood chips or the like, into pulp fibers. Mechanical treatments rely mainly on friction to separate fibers or fiber bundles from bulk material; chemical treatments generally act by eliminating constituents of the plant substances, such as lignin, that hold the fibers together.

Chemical pulp stock, i.e., pulp material produced by chemical treatment, which includes Kraft pulp and sulphite pulp stock, is often bleached to produce light colored pulp,often called "white pulp". Such bleached chemical pulp thereafter may be refined to achieve desired properties in the paper formed of such pulp. During such pulp stock refining, the pulp fibers are ground between elements, such as rotating metal plates, which crush and split the fibers, increasing fiber surface area and interfiber bonding.

Certain paper properties are dependent upon fiber surface area, and thus increase with pulp refining. For instance, where paper smoothness or paper strength are desired properties, pulp refining is continued to a significant degree and generally, the further the pulp material is refined, the smoother and stronger the paper produced therefrom will be.

Refining of chemical pulp, particularly bleached grades of such pulp, under typical commercial refining conditions, generally results in a significant loss of "brightness". The term "brightness" as used herein and as understood in the art, means the level of light reflected from a dry paper sheet formed of a given pulp, as compared to that of a standard. The higher the brightness rating, the lighter or whiter the appearance of the sheet. In many paper applications, particularly those that use bleached pulp stock in the first instance, brightness is an important paper property.

It is thus desirable to minimize brightness loss during pulp refining, particularly pulp refining of bleached grades of chemical pulp. It is desirable to provide a means for preventing such brightness loss that does not significantly add to the cost of the pulping and paper making process. It is desirable to provide a means for preventing such brightness loss that is not disruptive to such processes. It is desirable to provide such means in the form of a relatively inexpensive additive that does not interfere with such processes or with other desirable characteristics of the paper produced.

DISCLOSURE OF THE INVENTION

The present invention is a pulp refining process which includes the step of adding a blended additive to the pulp material, which blended additive comprises at least one anionic polymeric compound and an inorganic polyphosphate, in sufficient amounts to reduce brightness loss attendant upon pulp refining, and such blended additives for use in such a process, and pulp stock when refined by such processes.

By pulp refining, as that term is used herein, is meant the application of friction to pulp stock to crush pulp fibers, increasing fiber surface area, particularly when such friction is applied by metal elements. The term "pulp material" is used herein in a broad sense to mean plant substances that have been, are being, or are to be treated to produce an end product pulp. By pulp stock is meant pulp material already converted to pulp fibers. By pulp slurry is meant herein pulp material that is in the form of an aqueous slurry, particularly a slurry of pulp fibers.

In preferred embodiments, the present invention is a pulping or paper making process or the pulp refining stage of such processes wherein a blend comprising at least one anionic polymeric compound, preferably a low molecular weight anionic polymeric compound, and an inorganic polyphosphate, is added to pulp stock, preferably to such stock in the form of pulp slurry, preferably prior to subjecting such stock to pulp refining. Preferably the blend is added to such slurry at a level of about 0.0025 to about 0.5 weight percent based on dry pulp weight or from about 0.05 to about 10.0 pounds of blend per ton of dry pulp.

All percentages or ratios of additive to pulp, or additive components to each other, are based on the active component of the additive and not the total weight of product which in some instances would include diluents or stabilizers or the like.

The present invention in preferred embodiments is also an additive comprising in combination at least one anionic polymeric compound, preferably low molecular weight anionic polymeric compound, and at least one inorganic polyphosphate, particularly those combinations wherein the anionic polymeric compound or compounds have an average molecular weight, as determined by the Gel Permeation Chromotagraphic (GPC) peak height method, of from about 1,000 to about 10,000 and wherein the inorganic polyphosphate has a polymerization number (average number of monomeric units per polymer molecule) of from about 10 to about 45, and more preferably from about 10 to about 30.

BEST MODE FOR CARRYING OUT THE INVENTION

The pulp refining step of pulping and paper making processes, as mentioned above, is a process wherein the fiber surface area is increased. The degree or extent of such refining can be followed by the change in pulp freeness. Freeness is the readiness with which water drains freely from a pulp slurry. The greater the surface area of the pulp fibers, the lower is the pulp freeness, other factors being constant.

In pulp refining, the pulp stock, usually in a 1 to 6 percent aqueous slurry, is ground between metal elements, such as between rotating metal plates. Commercial paper mills have used multiple pass refining processes, wherein the pulp slurry passes through, and is ground in, a series of refiners. Many commercial refiners now use a single pass cone or disc refiner instead of multiple pass refiners. In any instance, the refiner or refiners, by friction or rolling action, crush and break apart the pulp fibers, increasing the surface area of the pulp fibers, and normally have for "refining targets" a given pulp freeness.

Prior to pulp refining, in addition to subjection to digesting liquors, such as kraft or sulphite liquors, many pulps are bleached with such agents as hypochlorites, other chlorine based systems, peroxides, or the like. Such bleached pulp material, which usually has been bleached in the first instance to raise the brightness, are particularly susceptible to loss of brightness upon subsequent pulp refining, and such losses increase generally with increasing degree of refining.

As mentioned above, the degree or extent of refining is often measured by pulp freeness. A commonly used, and accepted as accurate, measure of freeness is the Canadian Standard Freeness Test (TAPPI method T227), which is performed with equipment machined to standard dimensions. The method, in short, involves pouring a liter of pulp slurry into a cylinder with a wire gauze bottom. The material that flows through this bottom falls into a spreader cone with a side tube. The material that overflows through the side tube in a give time, measured in milliliters, is the freeness rating given the pulp. As pulp fiber surface area increases with refining, the pulp slurry releases less water during this test, resulting in a lower freeness rating.

Wood variables, such as wood species or type of wood, such as "hard wood" or "soft wood", affect to some extent the refining characteristics and properties of the paper produced. As to brightness of the paper produced, or brightness loss during pulp refining, that the pulp stock is chemical bleached stock has generally a greater effect than any effect due to type of wood used.

The loss of brightness during pulp refining of bleached chemical pulp stock can be of the magnitude of 10 points G.E. when refining to freenesses below 300 CFS. It is believed the brightness loss, and the extent of brightness loss, is dependent on the energy being applied to the pulp material during refining, the pH conditions during refining, the presence of metal ion contamination, and to a lesser extent, the type of wood from which the pulp is derived. It is also believed that under typical acidic refining conditions using iron based refiner elements, iron pick-up from the elements increases iron contamination, making such contamination a significant factor contributing to brightness loss. Avoidance of iron contamination, both that present often in the water used for preparing the pulp slurry and that picked up from the refiner elements, generally is not practical in commercial paper mills.

The introduction of an additive of the present invention into the process, preferably by its introduction and admixture with the pulp slurry prior to refining, lessens the degree of brightness loss upon refining and thus provides end product pulps from which papers of higher brightness are produced, without costly avoidance of iron contamination.

One component of the blend of the additive of the present invention is an anionic polymeric compound, which compounds are well known to those of ordinary skill in the art, and include such polymeric compounds as polyacrylic acid, polymaleic acid, polyacrylamide/acrylic acid copolymers, polyacrylic acid/vinylsulfonate copolymers, and the like. The additive can include one of such compounds or a plurality of such compounds. In preferred embodiment, any such anionic polymeric compounds included in the additive of the present invention are low molecular weight compounds, and more preferably are low molecular weight compounds having GPC peak height molecular weights within the range of about 1,000 to about 10,000. Even more preferable are those compounds in the lower portion of this range, i.e., those within the narrower range of GPC peak height molecular weight of from about 1,000 to about 5,000.

The additives of the present invention also include as a component at least one species of inorganic polyphosphate, i.e., polymers derived from inorganic phosphate compounds, such as polymeric condensation products of phosphoric acid and the like. The preferred inorganic polyphosphate polymers of the additive of the present invention are those having polymerization numbers of from about 10 to about 45, and more preferably from about 15 to about 30. An example of an inorganic polyphosphate that has been found effective in the present invention is the commercially available polyphosphate sold under the trademark GLASS H by the FMC Corporation. This polyphosphate is published as having a polymerization number of 21 and molecular weight of about 2,142, and formula of $(NaPO_3)_{21}$.

The blended additive should be added to the pulp material in sufficient amounts to reduce brightness to acceptable or desirable levels. It has been found that addition of additive in amounts within the range of from about 0.0025 to about 0.5 weight percent based on weight of dry pulp is a preferred dosage level, while a range of from about 0.01 to about 0.2 weight percent is an even more preferred range, particularly when the additive blend is one containing from about 2 to about 10 parts by weight of inorganic polyphosphate and from about 0.5 to about 2.0 parts by weight of low molecular weight anionic polymeric compound.

The proportion of anionic polymeric compound to inorganic polyphosphate can vary over a wide range, depending on the components selected. Proportions within the range of 1:10::10:1 parts by weight are believed sufficient to realize the invention's advantages, while proportions within the narrow range of 1:5::5:1 are preferred for their effectiveness. Since inorganic polyphosphates are often less expensive than anionic polymers, on a cost/performance basis another preferred range is 10:1::1::1, and more preferably 5:1::1:1, inorganic polyphosphate to anionic polymeric compound respectively.

Depending on the particular components used, the blend of the present invention can be used diluted, for instance with water, or admixed with salts, stabilizers and the like, or even admixed with other refining additives for other purposes. Some inorganic polyphosphates are supplied commercially in a solid salt form, while anionic polymers are often supplied as water solutions. Generally the blends can be prepared from the components as commercially supplied, diluting with water if necessary to achieve a desirable additive viscosity.

The examples and details below show further the manner of using the additives of the present invention to reduce brightness loss upon pulp refining.

The terms "points" or "brightness points" as used herein refer to numerical brightness ratings, or differentials between brightness ratings, as determined by TAPPI method T217 on a General Electric brightness meter. Such numerical ratings are also expressed as "G.E.'s", for instance "85 G.E." being a numerical brightness rating of 85 brightness points for this test, or a light reflection of 85% that of the standard.

The brightness loss on mechanical refining is progressive, continuing as refining continues. Thus it is expected that the brightness will be less for a pulp of lower freeness, other factors being the same. Further, as mentioned above, the loss of brightness is usually less dramatic where the iron contamination is less severe. The above correlations are demonstrated by the data set forth in Table 1 below, correlating brightness ratings with freeness as found for a typical pulp in a commercial double disc refiner. Two types of pulp slurry were used, differing as to iron contamination. Both were derived from softwood, had incoming freeness of about 700 CFS, and consistencies (weight percent pulp solids based on total slurry weight) of about 4 percent. Both were bleached stock.

TABLE 1

| | Pulp Slurry A | Pulp Slurry B |
|---|---|---|
| Iron contamination | 0.5 ppm | less than 0.1 ppm |
| pH | 4.0–5.0 | 5.5–6.0 |
| Incoming Brightness (G.E.) | 85 ± 0.5 | 85 ± 0.5 |
| Brightness at 400 CFS (G.E.) | 78–79 | 82–83 |
| Brightness at 200 CFS (G.E.) | 74–75 | 78–80 |

As shown in Table 1, pulp slurry A, having 0.5 ppm iron contamination, dropped at least 10 brightness points during refining from 700 CFS to 200 CFS. The low iron slurry, slurry B, had a less dramatic brightness loss of 5 to 7 points. Table 1 also illustrates the progressive nature of the loss of brightness, continuing as refining continues and freeness decreases.

For pulp slurries such as slurry A above in Table 1, those whose brightness would be expected to drop at least about 10 points during refining, the addition of an additive of the present invention, preferably before the slurry is subjected to refining, has been found in some instances to reduce brightness loss by about 70 to 80 percent. In such instances, the brightness rating differential between treated and untreated pulps can exceed 7 points at an intermediate refining stage, and 9 points at a highly refined stage. In general, the higher the degree of refining (the lower the freeness), the greater the brightness rating differential between paper made from treated and untreated pulps.

The blended additives of the present invention are generally more effective in preventing brightness loss during refining than the blends' individual components when used separately, and are effective over wider dosage ranges.

Brightness in all instances herein were determined by preparing hand sheets dried on heated drums from a sample of the pulp slurry at the refining stage indicated, and measuring the brightness of such sheets with a G.E. brightness meter according to the method described above.

EXAMPLE I

Bleached pulp stock was refined in a laboratory scale beater, a model imitative of a commercial multiple pass refiner system, which beater conformed to that required in TAPPI method T200. Such equipment was determined to reproduce the same magnitude of brightness loss experienced with commercial refiners, such as shown in Table 1 above. The incoming pulp stock was air-dried soft wood at a consistency (weight percent pulp solids based on total weight of aqueous slurry) of 2 percent and a pH of 4.0. The slurry was prepared with softened tap water containing about 0.5 ppm iron, and had an incoming G.E. brightness of 85±0.5 G.E. points.

This pulp slurry was divided into four portions, each refined separately. One portion was refined untreated, and thus is a control and standard on which the degree of prevention of brightness loss was determined. Another portion was treated with a blended additive of the present invention prior to refining. This additive was a blend of four parts by weight of inorganic polyphosphate, the commercially available Glass H, and one part by weight of solubilized polyacrylic acid ("polyacrylate") having a GPC peak height average molecular weight of 2100. This additive was used as a 25% water solution. Two other portions were treated respectively with the same polyacrylate and polyphosphate separately.

Table 2 below sets forth the dosage level at which the additives were added to the pulp slurry in weight percent additive based on dry weight of pulp basis. Table 2 also sets forth the brightness of each pulp slurry portion at several stages of the refining, as determined by pulp freeness, and the "brightness loss prevention", i.e., the differential between treated pulp brightness and the untreated standard at the same refining stage.

TABLE 2

| Pulp slurry Additive | none | blend | poly-acrylate | poly-phosphate |
|---|---|---|---|---|
| Weight % additive | — | 0.06 | 0.06 | 0.24 |
| Brightness (G.E.) at 700 CFS | 84.4* | 85.2 | 85.3 | 85.4 |
| Brightness (G.E.) at 450 CFS | 76.1 | 83.3 | 83.0 | 80.6 |
| Brightness (G.E.) at 150 CFS | 71.0 | 80.5 | 80.1 | 77.3 |
| Brightness loss prevention at 450 CFS | — | 7.2 | 6.9 | 4.5 |
| Brightness loss prevention at 150 CFS | — | 9.5 | 9.1 | 6.3 |

*Loss of brightness is seen prior to refining when no additive is used for slurries prepared with water containing 5 ppm iron.

As shown in Table 2 above, not only does the treatment with a blend of the polyphosphate/polyacrylate result in dramatic prevention of brightness loss, the pulp loosing only 4.7 brightness points upon refining from 700 CFS to 150 CFS, as compared to a loss of about 14 points for the control, the blend performed better than either of its components alone. Moreover, between the separate components, the polyacrylate performed about 50% better than the polyphosphate although added at one-fourth the dosage level of the latter. Nonetheless, the blend, containing four times as much polyphosphate as polyacrylate, still out performed the polyacrylate.

EXAMPLE II

A bleached pulp slurry stock was refined to a freeness of 150 CFS under stringent conditions regarding pH and metal contamination, eliminating most loss of brightness. This high-brightness refined pulp was divided into portions that were each treated as follows: diluted to a consistency of 0.2 percent; contaminated to a level of 0.5 ppm iron (added in the form of a $FeCl_3$ solution); stirred 15 seconds; treated with additive as set forth below; stirred 30 seconds; and left sitting for 30 minutes. After the 30 minutes, handsheets were made and the brightness determined therefrom.

As shown by the data set forth below in Table 3, in this test the magnitude of brightness loss, for instance by reference to the control, is commensurate with that experienced when bleached pulp slurry is refined in the presence of 0.5 ppm iron contamination.

The additive tested was the same 4 to 1 polyphosphate/polyacrylate blend described above in Example I. The refined pulp tested had an incoming pH of 4.5 and brightness of 83.6.

TABLE 3

| Pulp slurry additive | none | 4 to 1 polyphosphate/polyacrylate |
|---|---|---|
| Weight % additive based on dry weight of pulp | — | 0.06 |
| Resultant brightness (G.E.) | 73.4 | 79.9 |
| Brightness loss from initial brightness of 83.6 G.E. | 10.2 | 3.7 |

As shown in Table 3, for this simulated test, a 4 to 1 polyphosphate/polyacrylate blend prevented about 64 percent of the brightness loss experienced for the control.

EXAMPLE III

The simulated test of Example II above was repeated using refined bleached pulp having a freeness of 300 CFS and an incoming brightness of 85.6 G.E., other variables being the same. The additives tested were the same as used in Example I above. The resultant brightness losses are set forth below in Table 4.

TABLE 4

| Pulp slurry Additive | none | blend | poly-acrylate | poly-phosphate |
|---|---|---|---|---|
| Pounds of additive per dry ton pulp | — | 1.0 | 1.0 | 4.0 |
| Resultant brightness (G.E.) | 75.8 | 84.5 | 83.5 | 82.9 |
| Brightness loss from initial brightness of 85.6 | 9.8 | 1.1 | 2.1 | 2.7 |

As shown in Table 4, in this test the blend prevented about 89% of the brightness loss experienced with the control, as further compared to 78% for the polyacrylate alone and 72% for the polyphosphate alone.

The blended additive of the present invention achieves enhanced activity over the separate components and effectiveness over a greater dosage range.

INDUSTRIAL APPLICABILITY OF THE INVENTION

The present invention is applicable to the pulping and paper making industries, particularly to that industrial segment directed to pulp stock refining.

The above described particular embodiments of the invention, methods of operation, materials utilized, and combination of element can vary without changing the spirit of the invention as defined in the following claims.

We claim:

1. A pulp stock refining process, comprising:

adding to bleached chemical pulp stock a sufficient amount of a blended additive comprising in combination at least one low molecular weight acrylic acid containing polymeric compound and at least one inorganic polyphosphate, wherein the weight proportion of said inorganic polyphosphate to said acrylic acid containing polymeric compound is from about 1:10::10:1, to reduce brightness loss during pulp stock refining; and pulp stock refining said chemical pulp stock in the presence of said additive.

2. The process of claim 1 wherein said inorganic polyphosphate has an average polymerization number of from about 10 to about 45.

3. The process of claim 2 wherein said additive is added to said chemical pulp stock at a dosage of from about 0.0025 to about 0.5 weight percent based on weight of dry pulp.

4. The process of claim 3 wherein said acrylic acid containing polymeric compound has an average molecular weight of from about 1,000 to about 5,000, and said additive is added to said chemical pulp stock at a dosage of from about 0.01 to about 0.2 weight percent based on weight of dry pulp.

5. The process of claim 4 wherein said weight proportion of inorganic polyphosphate to acrylic acid containing polymeric compound in said additive is from about 5:1::1:1 respectively.

6. The process of claim 3 wherein said weight proportion of inorganic polyphosphate to acrylic acid containing polymeric compound in said additive is from about 5:1::1:1 respectively.

* * * * *